US009730471B2

(12) United States Patent
Li et al.

(10) Patent No.: US 9,730,471 B2
(45) Date of Patent: Aug. 15, 2017

(54) ATOMIZER AND ELECTRONIC CIGARETTE HAVING SAME

(71) Applicant: Shenzhen First Union Technology Co., Ltd., Shenzhen, Guangdong Province (CN)

(72) Inventors: Yonghai Li, Shenzhen (CN); Zhongli Xu, Shenzhen (CN)

(73) Assignee: SHENZHEN FIRST UNION TECHNOLOGY CO., LTD., Shenzhen, Guangdong Province (CN)

( * ) Notice: Subject to any disclaimer, the term of this patent is extended or adjusted under 35 U.S.C. 154(b) by 539 days.

(21) Appl. No.: 14/340,551

(22) Filed: Jul. 24, 2014

(65) Prior Publication Data

US 2015/0040927 A1 Feb. 12, 2015

(30) Foreign Application Priority Data

Aug. 7, 2013 (CN) ..... 2013 2 0479953 U

(51) Int. Cl.
*A24F 47/00* (2006.01)
*A24F 7/00* (2006.01)

(52) U.S. Cl.
CPC ..... *A24F 47/008* (2013.01); *A24F 7/00* (2013.01)

(58) Field of Classification Search
CPC ..... A24F 7/00
See application file for complete search history.

(56) References Cited

U.S. PATENT DOCUMENTS

2011/0011396 A1* 1/2011 Fang ..... A24F 47/008 128/202.21
2013/0192617 A1* 8/2013 Thompson ..... A24F 47/008 131/329
2013/0319438 A1* 12/2013 Liu ..... A24F 47/008 131/329

* cited by examiner

*Primary Examiner* — Alison L Hindenlang
*Assistant Examiner* — Jamel M Nelson
(74) *Attorney, Agent, or Firm* — Cheng-Ju Chiang

(57) ABSTRACT

An exemplary atomizer includes an atomizing sleeve, an air pipe received in the atomizing sleeve, a mouthpiece assembly arranged at one end of the atomizing sleeve, and an atomizing assembly received in the atomizing sleeve. The atomizing sleeve and the air pipe cooperatively define a sealed liquid reserving chamber for reserving tobacco liquid. The atomizing assembly includes a liquid obstruction cover and a glass fiber core. The liquid obstruction cover includes a sidewall. The sidewall and the atomizing sleeve cooperatively defining a gap. The glass fiber core is fixed by the sidewall, and two opposite ends of the glass fiber core are both positioned in the gap. The glass fiber core is configured for absorbing the tobacco liquid in the liquid reserving chamber through the gap.

13 Claims, 4 Drawing Sheets

ATOMIZER AND ELECTRONIC CIGARETTE HAVING SAME

TECHNICAL FIELD

The present invention relates to electronic cigarettes, and particularly to an atomizer and an electronic cigarette using same.

BACKGROUND ART

In a typical atomizer, tobacco liquid is stored in a sealed chamber, and then the tobacco liquid is conveyed by a glass fiber core. The absorption of the tobacco liquid is controlled by the glass fiber core. However, the glass fiber core may absorb excessive amount of the tobacco liquid. During transportation, the tobacco liquid absorbed in the glass fiber core may leak out from the atomizer, thus rendering the atomizer unsatisfactory.

What is needed, therefore, is a battery assembly and an electronic cigarette using same, which can overcome the above shortcomings.

SUMMARY

An exemplary atomizer includes an atomizing sleeve, an air pipe received in the atomizing sleeve, a mouthpiece assembly arranged at one end of the atomizing sleeve, and an atomizing assembly received in the atomizing sleeve. The atomizing sleeve and the air pipe cooperatively define a sealed liquid reserving chamber for reserving tobacco liquid. The atomizing assembly includes a liquid obstruction cover and a glass fiber core. The liquid obstruction cover includes a sidewall. The sidewall and the atomizing sleeve cooperatively defining a gap. The glass fiber core is fixed by the sidewall, and two opposite ends of the glass fiber core are both positioned in the gap. The glass fiber core is configured for absorbing the tobacco liquid in the liquid reserving chamber through the gap.

BRIEF DESCRIPTION OF THE DRAWINGS

Many aspects of the present disclosure can be better understood with reference to the following drawings. The components in the drawings are not necessarily drawn to scale, the emphasis instead being placed upon clearly illustrating the principles of the present disclosure. Moreover, in the drawings, like reference numerals designate corresponding parts throughout the several views.

DETAILED DESCRIPTION

Embodiments of the present disclosure will now be described in detail below and with references to the drawings.

Figure 1:
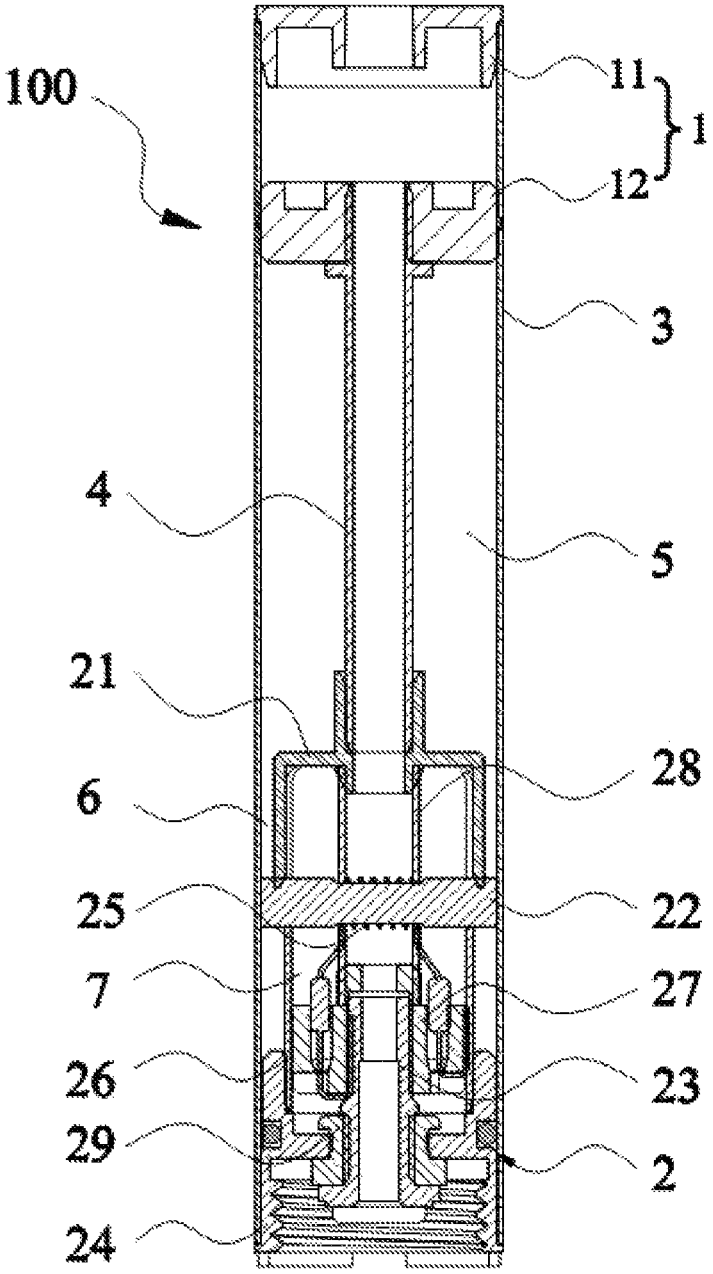
FIG. 1 is a cross-sectional view of an atomizer according to a first embodiment.

Referring to FIG. 1, an atomizer 100 according to a first embodiment includes a mouthpiece assembly 1, an atomizing assembly 2, and an atomizing sleeve 3. The atomizing sleeve 3 is cylindrical, the mouthpiece assembly 1 and the atomizing assembly 2 are arranged at two opposite ends of the atomizing sleeve 3, respectively. An air pipe 4 is arranged in the atomizing sleeve 3, and is connected between the mouthpiece assembly 1 and the atomizing assembly 2. A liquid reserving chamber 5 is formed between the atomizing sleeve 3 and the air pipe 4. Two opposite ends of the liquid reserving chamber 5 is sealed by the mouthpiece assembly 1 and the atomizing assembly 2. The liquid reserving chamber 5 is configured for storing tobacco liquid. The atomizing assembly 2 is configured for heating and atomizing the tobacco liquid to form an aerosol. The aerosol passes through the air pipe 4, and then reaches mouth of the user via the mouthpiece assembly 1.

The atomizing assembly 2 includes a liquid obstruction cover 21, a glass fiber core 22, a tubular electrode 23, and a metallic sleeve 24, and a heating wire 25 wound around the glass fiber core 22. One end of the air pipe 4 is inserted into the liquid obstruction cover 21.

In the present embodiment, the liquid obstruction cover 21 includes a sidewall 211, and a gap 6 is defined between the sidewall 211 and the atomizing sleeve 3. The gap 6 is annular in cross-section. The glass fiber core 22 is fixed by the sidewall 211, and two ends of the glass fiber core 22 are positioned in the gap 6, so that the glass fiber core 22 can absorbs tobacco liquid stored in the liquid reserving chamber 5.

In the present embodiment, the atomizing assembly 2 further includes a partition sleeve 26, the liquid obstruction cover 21 nests on top of the partition sleeve 26. The glass fiber core 22 is fixed between the partition sleeve 26 and the liquid obstruction cover 21. The liquid obstruction cover 21 and the partition sleeve 26 cooperatively define an atomizing cavity 7, which prevents the tobacco liquid from directly flowing in. Because two ends of the glass fiber core 22 are located in the gap 6, the tobacco liquid can flow to the glass fiber core 22 from the liquid reserving chamber 5 through the gap 6. Therefore, a speed of the tobacco liquid flowing to the glass fiber core 22 can be controlled by adjusting a width of the gap 6, and accordingly, the tobacco solution absorbed by the glass fiber core 22 can be controlled. The present atomizer 100 can eliminate the problems of the tobacco liquid leakage due to absorption of excessive tobacco liquid and burnt smell of the glass fiber core 22 due to absorption of inadequate tobacco liquid, thus improving the user experience.

To prevent the leakage of the tobacco liquid, the atomizer 100 further includes a fixing sleeve 27 and a liquid obstruction pipe 28. The fixing sleeve 27 is received in the partition sleeve 26. Two ends of the heating wire 25 extend through the fixing sleeve 27, and then are connected to the tubular electrode 23 and the partition sleeve 26 respectively. An upper end of the liquid obstruction pipe 28 is fixed in the liquid obstruction cover 21, while a lower end of the liquid obstruction pipe 28 is coupled with the fixing sleeve 27. The glass fiber core 22 is engaged in the middle of the liquid obstruction pipe 28.

Figure 2:
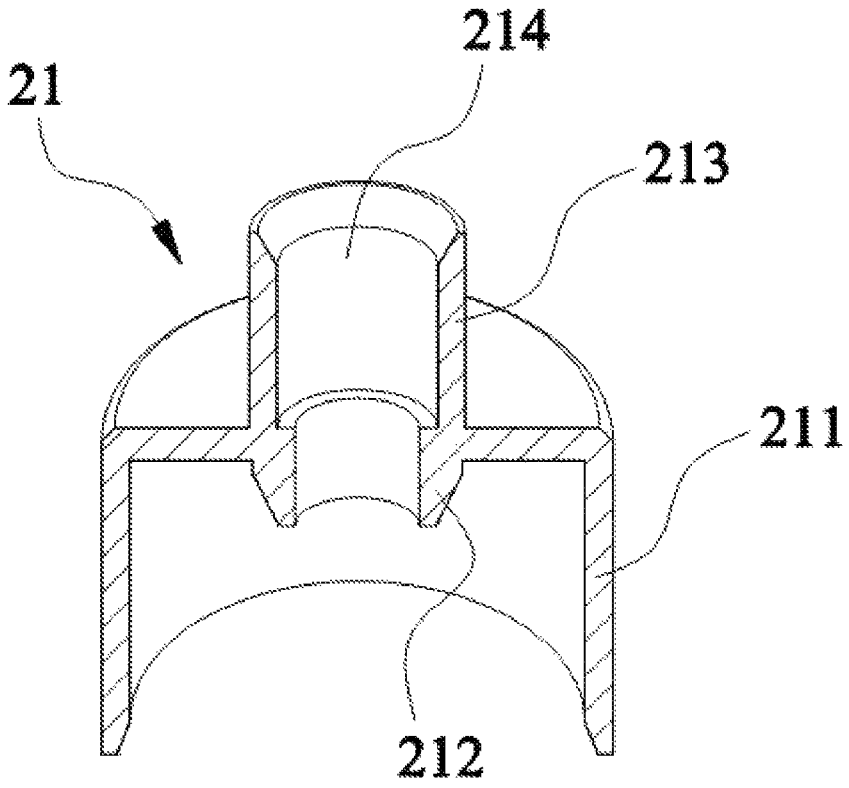
FIG. 2 is a cut-off perspective view of a liquid obstruction cover of the atomizer of FIG. 1.
Figure 3:
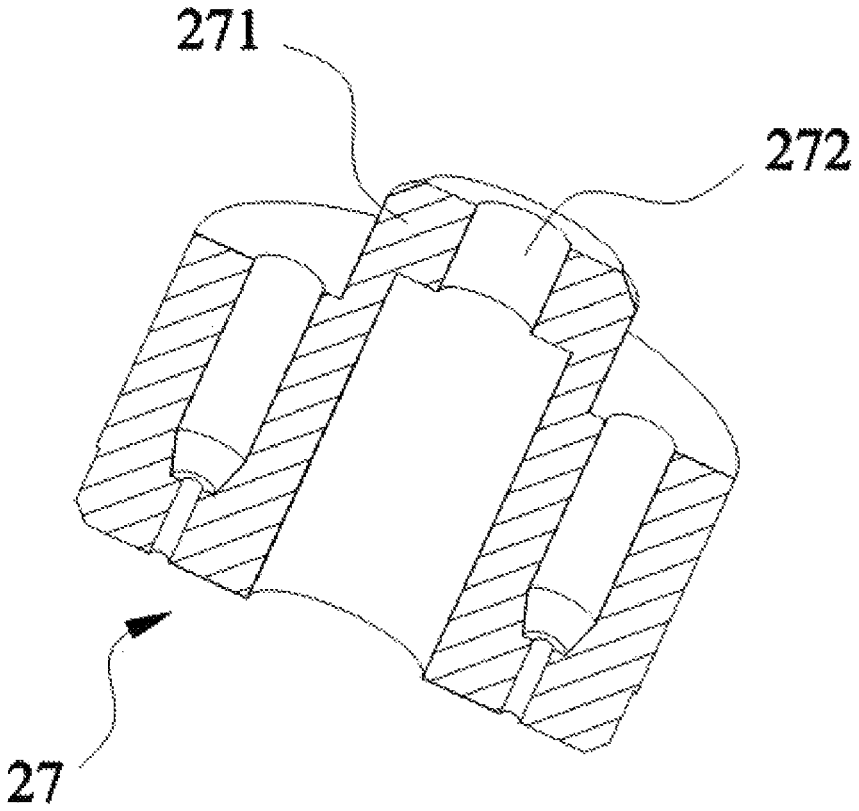
FIG. 3 is a cut-off perspective view of a fixing sleeve of the atomizer of FIG. 1.

More specifically, referring to FIGS. 2-3, the liquid obstruction cover 21 includes a flange 212 inside, and the fixing sleeve 27 includes a protruding stage 271. The upper end of the liquid obstruction pipe 28 is coupled with the flange 212. The lower end of the liquid obstruction pipe 28 is engaged with the protruding stage 271. The glass fiber core 22 extends through the liquid obstruction pipe 28, so that the heating wire 25 is positioned in the liquid obstruction pipe 28, and two opposite ends of the heating wire 25 extend downward in the liquid obstruction pipe 28.

A lower end of the partition sleeve 26 is inserted inside the metallic sleeve 24,and is hermetically fixed with the metallic sleeve 24, so that the liquid obstruction cover 21 and the partition sleeve 26 cooperatively form the atomizing cavity 7. The atomizing cavity 7 prevents the tobacco liquid from flowing in, and thus, prevents the tobacco liquid leaks out of the atomizer 100 via the tubular electrode 23.

A lower end of the tubular electrode 23 is fixed in the metallic sleeve 24, and an upper end of the tubular electrode 23 is inserted in the fixing sleeve 27, so that an air passage is cooperatively formed between the air pipe 4, the liquid obstruction cover 21, a liquid obstruction pipe 28, a fixing sleeve 27 and the tubular electrode 23. The aerosol can reach the mouth of the user through the air passage via the mouthpiece assembly 1.

The liquid obstruction cover 21 includes a connecting part 213 at the top. The connecting part 213 is configured for connecting with the air pipe 4. The connecting part 213 and the flange 212 are coaxial. The connecting part 213 defines a first through hole 214 along a central axis thereof The through hole 214 extends through the flange 212. The tubular electrode 23 has a hollow structure, and defines a second through hole 272 extending along a central axis thereof. Air flows subsequently along the tubular electrode 23, the second through hole 272, the liquid obstruction pipe 28, the first through hole 214, the air pipe 4, the mouthpiece assembly 1, bringing the aerosol generated by the heating wire 25 by heating the tobacco liquid to the mouthpiece assembly 1.

Because two ends of the heating wire 25 are respectively connected to the tubular electrode and the metallic sleeve 24, an insulated ring 29 is arranged between the tubular electrode 23 and the metallic sleeve 24 to avoid short circuit. The insulated ring 29 is fixedly engaged with the metallic sleeve 24, so that the insulated ring 29 will not fall from the metallic sleeve 24 when the tubular electrode 23 slides in the insulated ring 29.

The mouthpiece assembly 1 includes a mouthpiece cover 11 and a liquid stopper 12. The liquid stopper 12 nests the air pipe 4, and is engaged with the atomizing sleeve 3 by interference fit to form a hermetic connection, thus preventing the leakage of the tobacco liquid in the liquid reserving chamber 5.

Figure 4:
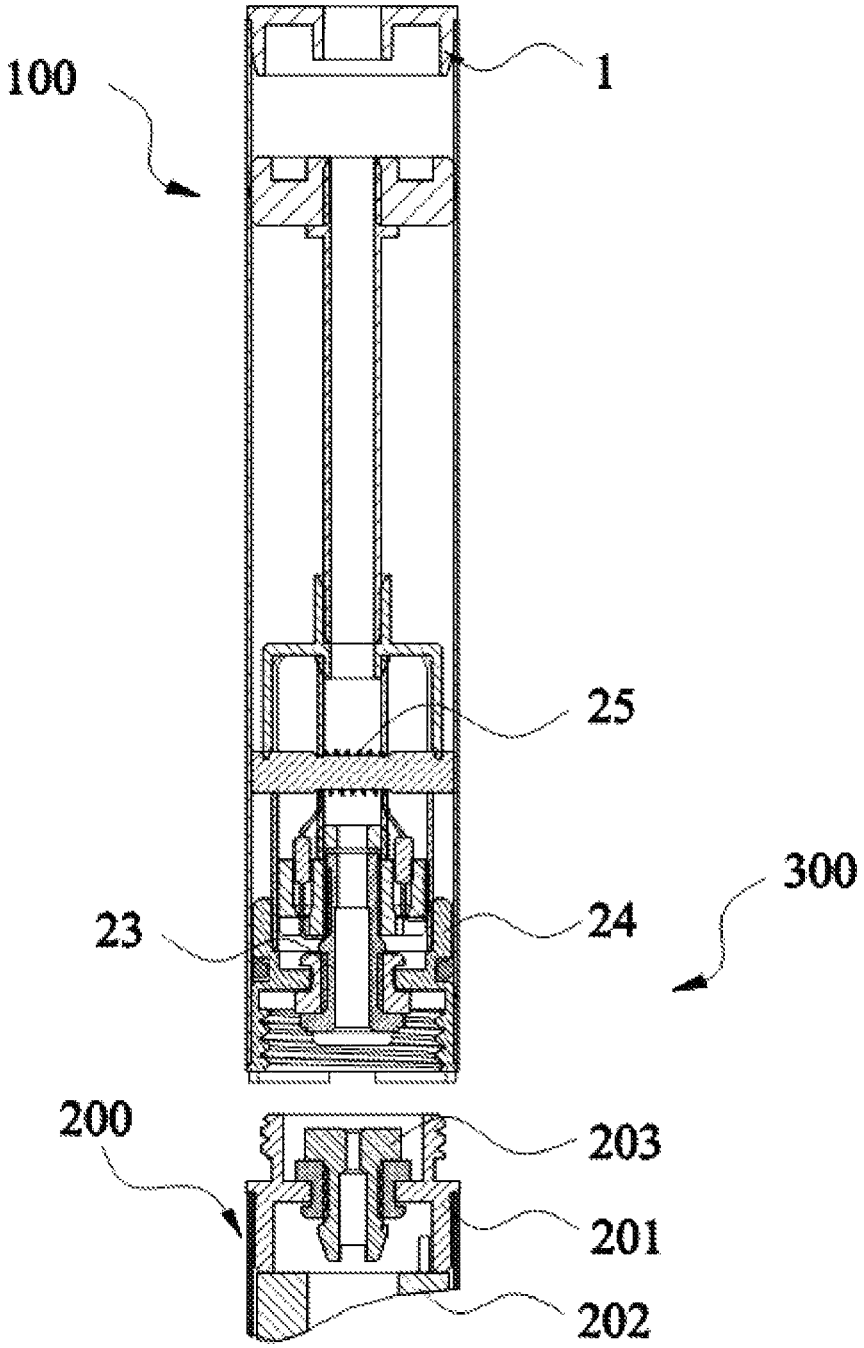
FIG. 4 is a cross-sectional view of an electronic cigarette according to a second embodiment.

Referring to FIG. 4, an electronic cigarette 300 according to a second embodiment is shown. The electronic cigarette 300 includes a battery pole 200 and an atomizer 100. The battery pole 200 is configured for powering the atomizer 100.

The battery pole 200 includes a connecting sleeve 201, a battery assembly 202, and a central pin 203 supported by the connecting sleeve 201. The connection sleeve is connected with a negative electrode of the battery assembly 202, and the central pin 203 is connected with a positive electrode of the battery assembly 202. The connection sleeve 201 has external threads formed at one end, and the metallic sleeve 24 has internal threads formed at one end. The connecting sleeve 201 is coupled to the metallic sleeve 24 via the internal and external threads, thus connecting the battery pole 200 and the atomizer 100.

When the battery pole 200 is threadedly coupled with the atomizer 100, the tubular electrode 23 is in contact with the central pin 203 to form an electrical connection, and the metallic sleeve 24 is in contact with the connecting sleeve 201 to form an electrical connection. In this status, the battery assembly 202 provides the heating wire 25 with power, the electronic cigarette 300 can be used.

It is understood that the above-described embodiments are intended to illustrate rather than limit the disclosure. Variations may be made to the embodiments and methods without departing from the spirit of the disclosure. Accordingly, it is appropriate that the appended claims be construed broadly and in a manner consistent with the scope of the disclosure.

What is claimed is:

1. An atomizer, comprising:

an atomizing sleeve;

an air pipe received in the atomizing sleeve, the atomizing sleeve and the air pipe cooperatively defining a sealed liquid reserving chamber for reserving tobacco liquid;

a mouthpiece assembly arranged at one end of the atomizing sleeve; and an atomizing assembly received in the atomizing sleeve, the atomizing assembly comprising a liquid obstruction cover and a glass fiber core, the liquid obstruction cover comprising a sidewall, the sidewall and the atomizing sleeve cooperatively defining a gap;

wherein the glass fiber core is fixed by the sidewall, two opposite ends of the glass fiber core are both positioned in the gap, the glass fiber core is configured for absorbing the tobacco liquid in the liquid reserving chamber through the gap;

wherein the atomizing assembly further comprises a partition sleeve, the liquid obstruction cover nests an upper end of the partition sleeve, the liquid obstruction cover and the partition sleeve cooperatively form an atomizing cavity, and the atomizing cavity communicates with the mouthpiece assembly via the air pipe;

wherein the atomizing assembly further comprises a tubular electrode and a fixing sleeve, the fixing sleeve is received in the partition sleeve, and the fixing sleeve nests an upper end of the tubular electrode; and wherein the liquid obstruction cover includes a flange inside, and the fixing sleeve includes a protruding stage, the atomizer further comprises a liquid obstruction pipe, an upper end of the liquid obstruction pipe is coupled with the flange, a lower end of the liquid obstruction pipe is engaged with the protruding stage, and the glass fiber core extends through the liquid obstruction pipe.

2. The atomizer of claim 1, wherein the atomizing assembly further comprises a metallic sleeve, the metallic sleeve is hermetically coupled with the atomizing sleeve, a lower end of the partition sleeve is inserted in the metallic sleeve, and a lower end of the tubular electrode is fixed in the metallic sleeve.

3. The atomizer of claim 2, wherein the atomizer further comprises an insulated ring arranged between the tubular electrode and the metallic sleeve, and the insulated ring is fixed in the metallic sleeve.

4. The atomizer of claim 1, wherein the liquid obstruction cover further comprises a connecting part configured for connecting with the air pipe, the connecting part and the flange are coaxial; the connecting part defines a first through hole along a central axis thereof, and the through hole extends through the flange.

5. The atomizer of claim 1, wherein the tubular electrode has a hollow structure, the protruding stage defines a second through hole coaxial with the tubular electrode, the tubular electrode, the second through hole, the liquid obstruction pipe, the first through hole, and the air pipe cooperatively form an air passage.

6. The atomizer of claim 1, wherein the mouthpiece assembly comprises a mouthpiece cover and a liquid stopper, the liquid stopper nests the air pipe, and is hermetically engaged with the atomizing sleeve.

7. The atomizer of claim 1, wherein the gap is annular in cross-section.

8. An electronic cigarette, comprising:

an atomizer, comprising:

an atomizing sleeve;

an air pipe received in the atomizing sleeve, the atomizing sleeve and the air pipe cooperatively defining a sealed liquid reserving chamber for reserving tobacco liquid;

a mouthpiece assembly arranged at one end of the atomizing sleeve; and an atomizing assembly received in the atomizing sleeve, the atomizing assembly comprising a liquid obstruction cover and a glass fiber core, the liquid obstruction cover comprising a sidewall, the sidewall and the atomizing sleeve cooperatively defining a gap;

wherein the glass fiber core is fixed by the sidewall, two opposite ends of the glass fiber core are both positioned in the gap, the glass fiber core is configured for absorbing the tobacco liquid in the liquid reserving chamber through the gap;

wherein the atomizing assembly further comprises a partition sleeve, the liquid obstruction cover nests an upper end of the partition sleeve, the liquid obstruction cover and the partition sleeve cooperatively form an atomizing cavity, and the atomizing cavity communicates with the mouthpiece assembly via the air pipe;

wherein the atomizing assembly further comprises a tubular electrode and a fixing sleeve, the fixing sleeve is received in the partition sleeve, and the fixing sleeve nests an upper end of the tubular electrode;

wherein the liquid obstruction cover includes a flange inside, and the fixing sleeve includes a protruding stage, the atomizer further comprises a liquid obstruction pipe, an upper end of the liquid obstruction pipe is coupled with the flange, a lower end of the liquid obstruction pipe is engaged with the protruding stage, and the glass fiber core extends through the liquid obstruction pipe; and a battery pole configured for powering the atomizer.

9. The electronic cigarette of claim 8, wherein the atomizing assembly further comprises a metallic sleeve, the metallic sleeve is hermetically coupled with the atomizing sleeve, a lower end of the partition sleeve is inserted in the metallic sleeve, and a lower end of the tubular electrode is fixed in the metallic sleeve.

10. The electronic cigarette of claim 9, wherein the atomizer further comprises an insulated ring arranged between the tubular electrode and the metallic sleeve, and the insulated ring is fixed in the metallic sleeve.

11. The electronic cigarette of claim 8, wherein the liquid obstruction cover further comprises a connecting part configured for connecting with the air pipe, the connecting part and the flange are coaxial; the connecting part defines a first through hole along a central axis thereof, and the through hole extends through the flange.

12. The electronic cigarette of claim 8, wherein the tubular electrode has a hollow structure, the protruding stage defines a second through hole coaxial with the tubular electrode, the tubular electrode, the second through hole, the liquid obstruction pipe, the first through hole, and the air pipe cooperatively form an air passage.

13. The electronic cigarette of claim 8, wherein the mouthpiece assembly comprises a mouthpiece cover and a liquid stopper, the liquid stopper nests the air pipe, and is hermetically engaged with the atomizing sleeve.

* * * * *